US006264827B1

(12) United States Patent
Okazaki et al.

(10) Patent No.: US 6,264,827 B1
(45) Date of Patent: Jul. 24, 2001

(54) MANUFACTURING PROCESS OF DIESEL GAS OIL WITH HIGH CETANE NUMBER AND LOW SULFUR

(75) Inventors: Hajime Okazaki; Katuhiko Ishikawa; Michiaki Adachi; Toshio Waku, all of Yokohama (JP)

(73) Assignee: Nippon Mitsubishi Oil Corp. (JP)

( * ) Notice: Subject to any disclaimer, the term of this patent is extended or adjusted under 35 U.S.C. 154(b) by 0 days.

(21) Appl. No.: 09/384,179

(22) Filed: Aug. 27, 1999

(30) Foreign Application Priority Data

Aug. 31, 1998 (JP) ..... 10-245565

(51) Int. Cl.[7] ..... C10G 45/00

(52) U.S. Cl. ..... 208/57; 208/15; 208/143; 208/144

(58) Field of Search ..... 210/15, 57

(56) References Cited

U.S. PATENT DOCUMENTS 4,371,727 * 2/1983 Gavin ..... 585/14
4,828,675 * 5/1989 Sawyer et al. ..... 208/57
4,849,093 * 7/1989 Vauk et al. ..... 208/143
4,864,067 * 9/1989 Harandi et al. ..... 585/254
5,183,556 * 2/1993 Reilly et al. ..... 208/57
5,391,291 * 2/1995 Winquist et al. ..... 208/143

* cited by examiner

*Primary Examiner*—Ellen M. McAvoy
(74) *Attorney, Agent, or Firm*—Ostrolenk, Faber, Gerb & Soffen, LLP

(57) ABSTRACT

A manufacturing process of a diesel gas oil with a high cetane number and a low sulfur, where the cetane number thereof is at least 45, the sulfur content thereof is less than 350 ppm, and the storage stability is superior, from a petroleum distillate oil with a low cetane number and a high sulfur content is provided. The process includes a first stage of contacting hydrogen with a petroleum distillate oil with a particular low cetane number, a particular high sulfur content, and a particular boiling point, in the presence of a catalyst of a porous solid acid carrier carrying a particular hydrogenation-active metals at a particular temperature and pressure to obtain a hydrogenated oil with a cetane number of at least 45 and a sulfur content of less than 350 ppm; and a second stage of contacting the obtained hydrogenated oil with hydrogen in the presence of a catalyst of a porous carrier carrying a hydrogenation-active metal at a particular temperature and pressure to obtain a hydrogenated oil with a superior storage stability without changing the cetane number and the sulfur content.

16 Claims, No Drawings

MANUFACTURING PROCESS OF DIESEL GAS OIL WITH HIGH CETANE NUMBER AND LOW SULFUR

BACKGROUND OF THE INVENTION

1. Field of the Invention

The present invention relates to a manufacturing process of a diesel gas oil with a high cetane number and a low sulfur. More particularly, the present invention relates to a manufacturing process of a diesel gas oil with a high cetane number, a low sulfur content, and a superior storage stability from a petroleum distillate oil with a low cetane number and a high sulfur content.

2. Background Art

Presently, diesel gas oil used in Japan is prepared by mixing a straight-run gas oil cut, a straight-run kerosene cut, a gas oil cut obtained from a cracking apparatus, or the like, with a desufurized gas oil cut which is obtained mainly by treating a straight-run gas oil with a general desulfurization apparatus. Considering that a clean oil will be required much more in the future, it is expected that in the diesel gas oil a content ratio of the gas oil cut obtained from the cracking apparatus will increase more and more. However, since the gas oil cut obtained from a fluid catalytic cracking (FCC) apparatus or a thermal cracking apparatus contains a lot of aromatic components, the cetane number thereof is low as it is. Additionally, the sulfur content thereof is usually at least 500 ppm, and there is not any less than 350 ppm. Furthermore, when the gas oil cut is hydrogenated, unstable substances are generated and the storage stability (hue and sludge amount) gets worse.

SUMMARY OF THE INVENTION

An object of the present invention is to provide a manufacturing process of a diesel gas oil with a high cetane number and a low sulfur, where the cetane number thereof is at least 45, the sulfur content thereof is less than 350 ppm, and the storage stability thereof is superior, from a petroleum distillate oil with a low cetane number and a high sulfur content.

In order to solve the aforesaid problems, the inventors have intensively studied and found that the diesel gas oil with a high cetane number, a low sulfur content, and a superior storage stability can be manufactured by a two-stages hydrogenation of the petroleum distillate oil with a low cetane number and a high sulfur content using a specific catalyst and condition.

Namely, the present invention provides a manufacturing process of a diesel gas oil with a high cetane number and a low sulfur content, comprising a first stage of contacting hydrogen with a petroleum distillate oil with a cetane number of at least 20 and less than 45, a sulfur content of at least 350 ppm, and a boiling point in the range of 200 to 430° C. in the presence of a hydrogenation catalyst of a porous solid acid carrier carrying one or more hydrogenation-active metals selected from the group consisting of chromium, molybdenum, tungsten, cobalt, and nickel, under a temperature from 320 to 500° C. and a pressure from 30 to 110 kg/cm$^2$ to obtain a hydrogenated oil with a cetane number of at least 45 and a sulfur content of less than 350 ppm; and a second stage of contacting hydrogen with the hydrogenated oil in the first stage in the presence of a hydrogenation catalyst of a porous solid acid carrier carrying one or more hydrogenation-active metals selected from the group consisting of chromium, molybdenum, tungsten, cobalt, and nickel, under a temperature from 200 to 400° C. and a pressure from 30 to 110 kg/cm$^2$ to obtain a hydrogenated oil with a superior storage stability without changing the cetane number and the sulfur content.

In the aforesaid process of the present invention, it is preferred that the porous solid acid carrier in the first stage be two or more oxides (complex oxide) selected from the group consisting of silica, alumina, titania, zirconia, boria, and magnesia, or one or more oxides selected from the oxides and zeolite or clay compounds.

In the aforesaid process of the present invention, it is preferred that the porous carrier in the second stage be alumina.

With the two-processes hydrogenation of the present invention, the diesel gas oil with the high cetane number and the low sulfur content, where the cetane number thereof is at least 45, the sulfur content is less than 350 ppm, and the storage stability is good, can be easily manufactured from the petroleum distillate oil where the cetane number thereof is at least 20 and less than 45, the sulfur content thereof is at least 350 ppm, and the boiling point thereof is in the range of 200 to 400° C.

DETAILED DESCRIPTION OF THE PREFERRED EMBODIMENTS

Hereinafter, the present invention will be explained in detail with reference to the preferred embodiments, but it will be understood that the invention is not limited thereto.

The petroleum distillate oil used as raw material oil in the present invention is the petroleum distillate oil whose cetane number is at least 20 and less than 45, whose sulfur content is at least 350 ppm, and whose boiling point is in the range of 200 and 430° C. Examples of the petroleum distillate oil include distillate oil obtained by fluid catalytic cracking (FCC), distillate oil obtained by thermal cracking, distillate oil obtained by distillation of crude oil under atmospheric pressure, distillate oil obtained by distillation of crude oil under reduced pressure, and a mixture of two or more of them.

In the present invention, the distillate oil with the cetarie number of at least 20 and less than 45, the sulfur content of at least 350 ppm, and the boiling point in the range of 200 to 430° C., is preferably used; where the distillate oil is a mixture of the distillate oil obtained by fluid catalytic cracking (FCC) and the distillate oil obtained by distillation of crude oil under atmospheric pressure, In accordance with the present invention, what is mainly performed in the first stage is the improvement of the cetane number by the ring opening with hydrogenation of the petroleum distillate oil and the lowering of the sulfur content by hydrodesulfurization. In the second stage, unstable substances with polycyclic aromatic structures which are mainly generated in the first stage and make worse the storage stability are removed. The unstable substances with specific polycyclic aromatic structures make the hue of the hydrogenated oil worse and generate sludge.

For the measurement of the storage stability, for example, ASTM method D-4625 is used for the hue (Saybolt color value) and the acceleration test in conformity to ASTM method D-2274 (the amount of the sludge) is for the sludge.

The hydrogenation temperature in the first stage of the invention is in the range of from 320 to 500° C., and preferably of 330 to 450° C. If the temperature is lower than 320° C., it is difficult to achieve the cetane number of at least 45. If the temperature is above 500° C., decomposition reaction occurs strikingly and induces the yield lowering.

The hydrogenation temperature in the first stage means the mean temperature of the reaction column (WABT).

The hydrogenation pressure in the first stage is in the range of 30 to 110 kg/cm$^2$, preferably of 35 to 80 kg/cm$^2$, and more preferably 40 to 65 kg/cm$^2$.

The hydrogenation pressure in the first stage means a hydrogen partial pressure.

The supply amount (liquid hourly space velocity: LHSV) of the petroleum distillate oil in the first stage is preferably in the range of 0.1 to 10 h$^{-1}$, and specially preferably in the range of 1 to 5 h$^{-1}$.

The hydrogen/oil ratio in the first stage is preferably in the range of from 200 to 5000 scf/bbl, and particularly preferably in the range of from 400 to 5000 scf/bbl.

In order to increase the cetane number in the first stage, not only the hydrogenation of the aromatic ring but also the ring opening is required. For the progress of the hydrogenation ring opening reaction, it is necessary for the catalyst to have an ability to cut the carbon-carbon bond of the ring, and therefore it is desirable to provide the solid acidity to the carrier.

The carrier is preferably one including two or more oxides (complex oxides) selected from the group consisting of silica, alumina, titania, zirconia, boria, and magnesia. Alternatively, the carrier is one including one or more oxides (complex oxides) selected from the aforesaid oxides, and zeolite and/or clay compounds. More preferably, alumina-boria or alumina-zeolite is used as the carrier.

The complex oxides may be obtained by well-known methods, such as a coprecipitation method, a kneading method, a precipitator method, and so on. For example, they can be prepared from complex hydroxide precipitated by adding alkaline to an acidic mixed aqueous solution including at least two elements selected from the aforementioned silica, alumina, titania, zirconia, boria, and magnesia; complex hydroxide precipitated by adding acid to an alkaline mixed aqueous solution including two or more of the aforesaid elements; complex hydroxide obtained by mixing an acidic solution containing one or more of the aforesaid elements and an alkaline solution containing one or more of the aforesaid elements; mixed compositions obtained by precipitating with adding an aqueous solution including the aforesaid one or more elements to hydroxides including the aforesaid one or more elements; or one obtained by adding the hydroxide or oxide or the precursor thereof including the aforesaid one or more elements to hydroxides including the aforesaid one or more elements.

Zeolite can be added at any time during the preparation process. The timing of the addition is preferably at the mixing time of the complex hydroxides, the aging time, or the kneading time.

The added amount of the zeolite is not limited specifically, but 0.1 to 30 wt % on the bases of the catalyst is preferable, and especially 0.5 to 10 wt % is preferable. Examples of the zeolite includes mordenite, X-type zeolite, and Y-type zeolite, and especially ultrastable Y-type zeolite is preferably used. As the silica-alumina ratio, the range of 5 to 300 thereof is preferable, and especially the range of 10 to 100 thereof is preferable.

As the clay compounds, stevensite, hectorite, saponite, montmorillonite, bentonite, sepiolite, and so on, are preferably used.

The calcination may be carried out under the condition for the calcination of the general catalyst carriers, and is preferably done over the temperature range of 400 to 800° C. for 5 to 6 hours.

If the hydrogenation-active metals are carried on the carrier, the hydrodesulfurization significantly progresses.

As the hydrogenation-active metals, one or more of the metals selected from the group consisting of chromium, molybdenum, tungsten, cobalt, and nickel are preferably used. As the particularly preferable metals, cobalt-molybdenum, nickel-molybdenum, or cobalt-molybdenum-nickel is used.

The hydrogenation-active metals can exist on the carrier in the form of metal, oxide, sulfide, or a mixture thereof.

As the carrying method, well-known methods, such as impregnation method, dipping method, kneading method, and so on may be adopted. It means that they may be added during the preparation of the complex hydroxides used for the carrier.

The carrying amount of the hydrogenation-active metals is preferably in the range of 2 to 30 wt % on the bases of the catalyst as oxides respectively, and especially 4 to 25 wt % is preferable.

The shape of the catalyst is any of grain shape, tablet shape, cylindrical shape, three leafed clover shape, and four leafed clover shape.

The catalyst manufactured described above may be used after preliminary sulfurization according to well-known method prior to the hydrogenation.

The type of the hydrogenation reaction column can be any of a fixed bed, a fluidized bed, or an expansion bed, and especially the fixed bed is preferably used.

For the contact of the hydrogen, the petroleum distillate oil, and the catalyst in the first stage, any method of a concurrent. upflow, a concurrent downflow, and a counter current may be adopted.

In the present invention, with the hydrogenation in the first stage, the cetane number of at least 45 and the sulfur content of less than 350 ppm are available.

Next, after the hydrogenation in the first stage, the hydrogenated oil can be supplied to the second stage as it is for the hydrogenation.

In the present invention, the hydrogenation temperature in the second stage is in the range of 200 to 400° C., and preferably in the range of 220 to 350° C. The removal of the unstable substances, which deteriorate the storage stability, does not progress adequately with both of the temperature lower than 200° C. and over 400° C.

The hydrogenation temperature in the second stage means the temperature at the highest temperature area in the reaction column (generally around the exit of the reaction column).

The hydrogenation pressure in the second stage is in the range of 30 to 110 kg/cm$^2$, preferably of 35 to 80 kg/cm$^2$, and more preferably 40 to 65 kg/cm$^2$. Furthermore, the pressure in the second stage is preferably same to or higher than that in the first stage.

The hydrogenation pressure in the second stage means the hydrogen partial pressure.

The hydrogen partial pressure in the second stage is preferably same to or higher than that of the first stage.

The supply amount (liquid hourly space velocity: LHSV) of the petroleum distillate oil in the second stage is preferably in the range of 0.1 to 20 h$^{-1}$, and particularly preferably in the range of 4 to 12 h$^{-1}$.

The hydrogen/oil ratio in the second stage is preferably in the range of 200 to 5000 scf/bbl, and particularly preferably in the range of 400 to 5000 scf/bbl.

As the catalyst for the hydrogenation in the second stage, a porous carrier with hydrogenation-active metals is used.

As the porous carrier, alumina is preferably used. Besides alumina, silica, titania, zirconia, boria, magnesia, and so on can be included with not more than 5 wt %.

As the hydrogenation-active metals, one or more of the metals selected from chromium, molybdenum, tungsten, cobalt, and nickel are used.

Especially, as the catalyst in the second stage, the catalyst of alumina carrier with cobalt-molybdenum, nickel-molybdenum, or cobalt-molybdenum-nickel active metals is preferably used.

The carrying amount of the hydrogenation-active metals is preferably in the range of 1 to 25 wt % on the bases of the catalyst as oxides respectively, and especially 3 to 20 wt % is preferable.

The hydrogenation catalyst in the second stage may be used after preliminary sulfurization according to well-known method prior to the hydrogenation.

The type of the hydrogenation reaction column in the second stage may be any of a fixed bed, a fluidized bed, or an expansion bed, and especially the fixed bed is preferably used.

For the contact of the hydrogen, the petroleum distillate oil, and the catalyst in the second stage, any method of a concurrent upflow, a concurrent downflow, and a counter current maybe adopted.

In the present invention, the first stage and the second stage are used in series, but are not limited to the continuous operation and the operations corresponding to the first stage and the second stage may be done separately.

As concerning of the relationship of the temperature of the first stage and the second stage, the temperature of the second stage is preferably lower than that of the first stage when the hydrogen partial pressures of the first stage and the second stage are almost same. Furthermore the temperature of the second stage is preferably lower than that of the first stage by 70 to 200° C.

After the hydrogenation in the second stage, the hydrogenated oil can be subjected to a stripping or a separation of gas oil portion if necessary.

With the hydrogenation in a second stage, the hydrogenated oil with superior storage stability can be obtained without changing the cetane number and the sulfur content of the hydrogenated oil.

EXAMPLES

In the following, the present invention will be explained in detail with the examples, but the invention is not limited thereto.

(Examples 1 and 2)

The two-stages hydrogenation was carried out with the reaction condition shown in Table 1, using the distillate oil (light cycle oil: LCO) obtained by the fluid catalytic cracking (FCC) with the cetane number of 34, the sulfur content of 4200 ppm, and the boiling point in the range of 210 to 352° C. as the raw fuel.

As the catalyst in the first stage, the following two types of catalysts were used.

Catalyst A: The catalyst where 1 wt % of ultrastable Y-type zeolite (silica-alumina ratio 12), 5 wt % of CoO, and 18 wt % of $MoO_3$ are carried on an alumina carrier.

Catalyst B: The catalyst where 10 wt % of boria, 5 wt % of CoO, and 18 wt % of $MoO_3$ are carried on an alumina carrier.

As the hydrogenation catalyst in the second stage, the catalyst C where 5 wt % of NiO and 15 wt % of $MoO_3$ were carried on an alumina carrier was used.

The said catalysts were preliminary sulfurized with the well-known method. The reaction columns of the first stage and the second stage are in series, and the hydrogenation was continuously carried out.

The results are shown in Table 1.

(Comparative Examples 1 to 5)

The two-stage hydrogenation was done in the reaction condition shown in Table 1 using the same distillate oil with that used in the examples 1 and 2 as the raw material oil.

As the catalysts in the first and second stages, the catalysts shown in Table 1 were used.

The results are shown in Table 1.

TABLE 1

| | Ex. 1 | Ex. 2 | Com. Ex. 1 | Com. Ex. 2 | Com. Ex. 3 | Com. Ex. 4 | Com. Ex. 5 |
|---|---|---|---|---|---|---|---|
| Hydrogenation in the first stage | | | | | | | |
| Reaction conditions | | | | | | | |
| Catalysts | Cat. A | Cat. B | Cat. A | Cat. A | Cat. A | Cat. A | Cat. C |
| Hydrogen pressure ($kg/cm^2$) | 60 | 60 | 60 | 60 | 60 | 60 | 60 |
| Reaction temperature (° C.) | 370 | 385 | 300 | 520 | 370 | 370 | 385 |
| LHSV ($hr^{-1}$) | 4 | 4 | 4 | 4 | 4 | 4 | 4 |
| Hydrogen/oil (scf/bbl) | 2000 | 2000 | 2000 | 2000 | 2000 | 2000 | 2000 |
| Nature of the treated oil | | | | | | | |
| Yield of the gas oil (mass %) | 99 | 99 | 100 | 39 | 99 | 99 | 99 |
| Cetane number | 50 | 52 | 39 | 32 | 50 | 50 | 42 |
| Sulfur content (mass ppm) | 44 | 47 | 1400 | 1> | 44 | 44 | 55 |
| Saybolt value | −16> | −16> | −16> | −16> | −16> | −16> | −16> |
| Amount of sludge (mg/100 ml) | 2.7 | 3.1 | 0.7 | 4.9 | 2.7 | 2.7 | 2.8 |
| Hydrogenation in the second stage | | | | | | | |
| Reaction conditions | | | | | | | |
| Catalysts | Cat. C | Cat. C | Cat. C | Cat. C | Cat. C | | Cat. C |
| Hydrogen pressure ($kg/cm^2$) | 60 | 60 | 60 | 60 | 60 | | 60 |
| Reaction temperature (° C.) | 240 | 240 | 240 | 240 | 180 | | 240 |
| LHSV ($hr^{-1}$) | 8 | 8 | 8 | 8 | 8 | | 8 |
| Hydrogen/oil (scf/bbl) | 2000 | 2000 | 2000 | 2000 | 2000 | | 2000 |
| Nature of the treated oil | | | | | | | |
| Yield of the gas oil (mass %) | 99 | 99 | 100 | 39 | 99 | 99 | 99 |
| Cetane number | 50 | 52 | 39 | 32 | 50 | 50 | 42 |
| Sulfur content (mass ppm) | 44 | 47 | 1400 | 1> | 44 | 44 | 55 |
| Saybolt value | +20 | +11 | −12 | −9 | −16> | −16> | +12 |
| Amount of sludge (mg/100 ml) | 0.8 | 1.1 | 0.6 | 3.6 | 2.1 | 2.7 | 1.0 |

Table 1 shows that in Comparative Example 1 the cetane number of the obtained product gas oil does not increase enough, the sulfur content does not decrease enough, and the storage stability is not improved. In Comparative Example 2, the sulfur content of the obtained product gas oil decreases enough, but the cetane number decreases, the yield is low, and also the storage stability is not improved. In Comparative Example 3, the cetane number of the obtained product gas oil increases enough and the sulfur content decreases enough, but the storage stability is not improved. In Comparative Example 4, where the second stage is omitted, the cetane number of the obtained product gas oil increases enough, the sulfur content decreases enough, but the storage stability is not improved. In Comparative Example 5, where catalyst without cracking function was used in the first stage, neither of the cetane number nor the sulfur content shows good results.

On the contrary, as it is clearly understood by the results of the Examples 1 and 2 according to the present invention, in order to manufacture the diesel gas oil with the cetane number of at least 45, sulfur content of less than 350 ppm, and superior storage stability from the petroleum distillate oil with the cetane number of at least 20 and less than 45, sulfur content of at least 350 ppm, and boiling point in the range of 200 to 400° C., the two-stage hydrogenation process according to the present invention is effective.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A manufacturing process of diesel gas oil with a high cetane number and a low sulfur content, said process comprising a first stage of contacting hydrogen with a petroleum distillate oil with a cetane number of at least 20 and less than 45, a sulfur content of at least 350 ppm, and a boiling point in the range of 200 to 430° C. in the presence of a hydrogenation catalyst of a porous solid acid carrier carrying one or more hydrogenation-active metals selected from the group consisting of chromium, molybdenum, tungsten, cobalt and nickel, and a temperature from 320 to 500° C. and a pressure from 30 to 110 kg/cm$^2$ to obtain a hydrogenated oil with a cetane number of at least 45 and sulfur content of less than 350 ppm; and a second stage of contacting hydrogen with the hydrogenated oil from the first stage in the presence of a hydrogenation catalyst of a porous carrier carrying one or more hydrogenated-active metals selected from the group consisting of chromium, molybdenum, tungsten, cobalt and nickel, under a temperature from 200 to 400° C. and a pressure from 30 to 110 kg/cm$^2$ to obtain a hydrogenated oil with a superior storage stability without changing the cetane number and the sulfur content, wherein the temperature in the second stage is lower than the temperature in the first stage.

2. A manufacturing process of a diesel gas oil with a high cetane number and a low sulfur according to claim 1, wherein said porous solid acid carrier used in the first stage is two or more oxides (complex oxides) selected from the group consisting of silica, alumina, titania, zirconia, boria, and magnesia, or one or more oxides selected from said oxides and zeolite or clay compound.

3. A manufacturing process of a diesel gas oil with a high cetane number and a low sulfur content according to claim 1, wherein said porous carrier used in the second stage is alumina.

4. A manufacturing process of a diesel gas oil with a high cetane number and a low sulfur content according to claim 2, wherein said porous carrier used in the second stage is alumina.

5. A manufacturing process of a diesel gas oil with a high cetane number and sulfur content according to claim 1, wherein a temperature from 330 to 450° C. and pressure from 35 to 80 kg/cm$^2$ is employed in the first stage and a temperature of 220–350° C. and a pressure of 35 to 80 kg/cm$^2$ is employed in the second stage.

6. A manufacturing process of a diesel gas oil with a high cetane number and sulfur content according to claim 5, wherein the pressure in the first and second stage is 40 to 65 kg/cm$^2$.

7. A manufacturing process of a diesel gas oil with a high cetane number and sulfur content according to claim 6, wherein the petroleum distillate oil is a mixture of distillate oil obtained by fluid catalytic cracking and distillate oil obtained by distillation of crude oil under atmospheric pressure.

8. A manufacturing process of a diesel gas oil with a high cetane number and low sulfur content according to claim 7, wherein the porous carrier used in the first stage is alumina-boria or alumina-zeolite and the porous carrier used in the second stage is alumina.

9. A manufacturing process of a diesel gas oil with a high cetane number and sulfur content according to claim 8, wherein the hydrogenation-active metal in the first and second stage are individually selected from the group consisting of cobalt-molybdenum, nickel-molybdenum and cobalt-molybdenum-nickel.

10. A manufacturing process of a diesel gas oil with a high cetane number and sulfur content according to claim 9, wherein the first and second stage hydrogenation are carried out in a fixed catalyst bed.

11. A manufacturing process of a diesel gas oil with a high cetane number and sulfur content according to claim 1, wherein the pressure in the first and second stage is 40 to 65 kg/cm$^2$.

12. A manufacturing process of a diesel gas oil with a high cetane number and sulfur content according to claim 1, wherein the petroleum distillate oil is a mixture of distillate oil obtained by fluid catalytic cracking and distillate oil obtained by distillation of crude oil under atmospheric pressure.

13. A manufacturing process of a diesel gas oil with a high cetane number and low sulfur content according to claim 1, wherein the porous carrier used in the first stage is alumina-boria or alumina-zeolite and the porous carrier used in the second stage is alumina.

14. A manufacturing process of a diesel gas oil with a high cetane number and sulfur content according to claim 1, wherein the hydrogenation-active metal in the first and second stage are individually selected from the group consisting of cobalt-molybdenum, nickel-molybdenum and cobalt-molybdenum-nickel.

15. A manufacturing process of a diesel gas oil with a high cetane number and sulfur content according to claim 1, wherein the first and second stage hydrogenation are carried out in a fixed catalyst bed.

16. A manufacturing process of a diesel gas oil with a high cetane number and sulfur content according to claim 1, wherein the temperature in the second stage is 70 to 200° C. lower than the temperature in the first stage.

* * * * *